United States Patent [19]

Nakamura

[11] Patent Number: 4,593,896

[45] Date of Patent: Jun. 10, 1986

[54] STACKING APPARATUS FOR PAPER SHEETS

[75] Inventor: Kunihiko Nakamura, Yokohama, Japan

[73] Assignee: Tokyo Shibaura Denki Kabushiki Kaisha, Kawasaki, Japan

[21] Appl. No.: 594,897

[22] Filed: Mar. 29, 1984

[30] Foreign Application Priority Data

Mar. 31, 1983 [JP] Japan ..... 58-53781

[51] Int. Cl.[4] ..... B65H 29/40; B65H 33/16; B65H 31/32

[52] U.S. Cl. ..... 271/186; 271/187; 271/189; 271/218; 271/315

[58] Field of Search ..... 271/186, 187, 188, 189, 271/192, 308, 312, 313, 314, 315, 218, 213

[56] References Cited

U.S. PATENT DOCUMENTS 4,357,126 11/1982 Kidd et al. ..... 271/218 X
4,431,178 2/1984 Kokubo et al. ..... 271/187
4,470,590 9/1984 Ariga et al. ..... 271/186 X

FOREIGN PATENT DOCUMENTS 0102814 3/1984 European Pat. Off. ..... 271/186

*Primary Examiner*—Bruce H. Stoner, Jr.
*Assistant Examiner*—Lawrence J. Goffney, Jr.
*Attorney, Agent, or Firm*—Oblon, Fisher, Spivak, McClelland & Maier

[57] ABSTRACT

In a paper sheet stacking apparatus according to the present invention, continuously fed paper sheets are received by rotating blade wheels, and are then dropped from the blade wheels at a predetermined position by means of a stationary stop. A separator capable of rotating coaxially with the blade wheels is stopped at the paper sheet dropping position to bear thereon the first of many sheaves of paper sheets to be allotted out of the dropped paper sheets. The paper sheets on the separator is temporarily transferred to an auxiliary stacking unit, and the separator is removed from the blade wheels. Then, the separator is rotated without touching the paper sheets and stopped at a position beside a stand-by position where it waits for the first paper sheet out of the next sheaf of paper sheets to be inserted into the blade wheels. Thereafter, the separator is moved further toward the blade wheels and stopped at the stand-by position. Meanwhile, the paper sheets on the auxiliary stacking unit are transferred to a main stacking unit so that the main stacking unit can receive and bear thereon the paper sheets to be dropped thereafter. Thus, regular sheaves of paper sheets each consisting of a predetermined number of sheets may successively be formed on the main stacking unit without interrupting the feed of the paper sheets to the blade wheels.

3 Claims, 18 Drawing Figures

STACKING APPARATUS FOR PAPER SHEETS

BACKGROUND OF THE INVENTION

The present invention relates to a paper sheet stacking apparatus for dividing continuously fed paper sheets into regular sheaves each consisting of a predetermined number of paper sheets, which comprises a blade wheel means rotating about a substantially horizontal axis of rotation, the vane wheel means having a plurality of blades extending from the central portion to the outer periphery thereof in the direction opposite to the rotating direction thereof, each two adjacent blades defining therebetween a space having an opening on the outer periphery of the blade wheel means, feeding means for continuously inserting the paper sheets into the spaces, one for each space, through the openings of the blade wheel means passing a predetermined receiving position, a stationary stop adapted to abut against the paper sheets held in the spaces and rotating together with the blade wheel means, thereby stopping the rotation of the paper sheets, so that the paper sheets are discharged from the spaces of the vane wheel means and dropped automatically, and main stacking means for receiving and bearing thereon the paper sheets discharged from the blade wheel means.

Paper sheet stacking apparatuses of this type are generally known. Paper sheets of documents, such as bank notes, data cards, printed matter, etc., are conventionally processed in a mechanized system. Since these documents have recently been increasing steadily, there is an urgent demand for the development of high-speed processing apparatuses for them.

For example, processing of bank notes includes a step of tying them up with bands or the like into bundles each consisting of a predetermined number of bank notes. In executing this process, it is not very efficient to manually divide the paper sheets into lots. Usually, therefore, the paper sheets are divided into regular sheaves each including a predetermined number of sheets on an automatic processing apparatus, and the sheaves are then tied up with bands. Such an automatic processing apparatus is preferably constructed so that the paper sheets fed one by one at high speed can continuously be stacked without interrupting the feed of the paper sheets, and that the division into the regular sheaves is achieved in the course of the stacking process.

Conventional paper sheet stacking means to fulfill these requirements include the so-called beating system, in which the paper sheets delivered from the delivery-side end of conveyor means and flying in the air are beaten down. In this stacking means, there is a limit to the high-speed response characteristic of direction changing means for the sheet papers. Since the cycle of the direction changing means is raised by high-speed vibration with constant amplitude, so the force of inertia is increased. Thus, the operation of the direction changing means becomes unstable, or the force applied to the mechanical part is increased. To cope with this, the apparatus is increased in size and therefore in cost. In the beating system, moreover, the force used in beating the paper sheets is so great that some of the paper sheets may be stacked in folded or torn states. Consequently, the beating system is not a suitable system for high-speed paper sheet stacking.

There is a system in which a blade wheel is used for stacking means to cover up these drawbacks. In this system, the blade wheel has a plurality of elongate blades extending from the central portion of the blade wheel in the direction opposite to the rotating direction and arranged along the circumference of the blade wheel. Paper sheets are fed into slender spaces formed between the blades of the blade wheel, rotated together with the blade wheel through a predetermined angle, and then discharged from the blade wheel at a predetermined position to be stacked in place. According to this system, if the number of the paper sheets per minute successively inserted into the slender spaces is N, then the revolution per minute of the blade wheel is $n=N/m$ RPM , where m is the number of the spaces. In order words, the rotary speed n of the blade wheel is obtained by dividing the number of paper sheets to be fed per minute by the number of the spaces. This implies that the blade wheel is rotated relatively slowly. Even in a case such that, for example, 1,800 paper sheets are supplied every minute to the blade wheel, the rotary speed n of the blade wheel may be as low as 100 (rpm) if the spaces used are 18 in number. Accordingly, the blade wheel need not be rotated at high speed, and hence will not cause any trouble in high-speed paper sheet processing.

Thus, the blade wheel system has many advantages over the other stacking systems. Paper sheet stacking apparatuses have conventionally been proposed which combine the stacking means using the blade wheel with dividing means capable of dividing paper sheets into regular sheaves without interrupting the feed of the paper sheets. An example of such apparatuses is disclosed in Japanese Patent Application No. 26369/81. This apparatus is provided with a separator which includes an arm portion having an axis of rotation substantially in alignment with that of the blade wheel and extending from the axis to a position beyond the peripheral edge of the blade wheel along the side face thereof, and a receiving portion at the distal end of the arm portion. As the separator is rotated as required, paper sheets held individually in spaces of the blade wheel abut against the arm portion to be removed from the spaces. The removed paper sheets are temporarily held by the receiving portion. In the meantime, paper sheets previously removed by a stationary-stop-end stacked-on stacking means are delivered. Thereafter, the paper sheets on the receiving portion of the separator are transferred to the stacking means.

However, the conventional paper sheet stacking apparatus combining the blade-wheel stacking means and dividing means have the following problems. In temporarily receiving the paper sheets following a predetermined number of sheets by means of the separator, the arm portion of the separator is used as a stop for removing the aforesaid paper sheets from the spaces of the blade wheel, and the removed paper sheets are held by the receiving portion. Therefore, the arm portion is naturally located within the range of the width (along the axis of rotation of the blade wheel) of the paper sheets in the spaces of the blade wheel. Accordingly, when the separator is located in the section between the position for the feed of the paper sheets into the blade wheel and the position for the start of division or receiving, the depth of the spaces of the blade wheel is practically reduced by the existence of the arm portion. Thus, the rear edge portions of those paper sheets which are fed into the blade wheel while the separator is in the aforesaid intermediate section project from the spaces.

The projecting portions will close the opening of each following space to receive the next paper sheet, thereby preventing the following paper sheet from entering its corresponding space. Thereupon, the rejected paper sheet will run against the one blocking its entrance and cause a jam. In order to avoid such an awkward situation, the interval of feed of the paper sheets into the blade wheel is inevitably lengthened, so that it is impossible to speed up the paper sheet processing. Further, the division of the paper sheets into the regular sheaves in stacking requires the separator to be rotated intermittently. The intermittent drive of the separator requires great power, so that the conventional stacking apparatus is high in power consumption.

SUMMARY OF THE INVENTION

The present invention is contrived in consideration of these circumstances, and is intended to provide a paper sheet stacking apparatus capable of uninterruptedly dividing paper sheets fed one by one at regular intervals into regular sheaves, each consisting of a predetermined number of sheets, without deteriorating the high-speed performance innate in a blade wheel stacking system, and reduced in power consumption for the division.

In order to acheive the above object, a paper sheet stacking apparatus according to the invention is provided with separator means rotatably supported in substantially coaxial relation with blade wheel means and capable of receiving dropped paper sheets; the separator means having an arm portion extending in the radial direction of the blade wheel means to a position beyond the outer periphery of the blade wheel means via the side of paper sheets held in the blade wheel means; and a receiving portion for receiving the dropped paper sheets, the paper sheets dropped from the blade wheel means being adapted to be stacked on the receiving portion when the separator means is brought close to the blade wheel means and is rotated to reach a receiving position where the receiving portion receives the dropped paper sheets; a rotating mechanism for rotating the separator means; a linear drive mechanism for moving the separator means toward the axis of rotation of the blade wheel means; auxiliary stacking means for transferring the paper sheets on the receiving portion of the separator means to main stacking means; and control means adapted to rotate the separator means located in the position close to the blade wheel means and stopping in a stand-by position beyond a receivng position of the blade wheel means as viewed along the rotating direction thereof, to stop the separator means at the receiving position so that the receiving portion of the separator means is brought to the position where the receiving portion can receive each regular sheaf of paper sheets before the first paper sheet out of the sheaf is dropped from the blade wheel means, to drive the auxiliary stacking means so that the auxiliary stacking means supports the paper sheets in place of the receiving portion after the separator means starts receiving the paper sheets, to stack the paper sheets discharged from the blade wheel means on the auxiliary stacking means, and to rotate the separator means to the position beside the stand-by position after moving the separator means, having so far been at a standstill, to the position beside the receiving position and then transfer the separator means again to the stand-by position by axial movement.

In the paper sheet stacking apparatus according to the invention, the paper sheets fed into the blade wheel means will never be touched by the arm portion of the separator wherever the separator is located. Accordingly, the paper sheets can always be inserted quickly and fully into spaces of the blade wheel means. It is therefore unnecessary to secure long feed intervals for the paper sheets that are required by the prior art apparatuses. Thus, the paper sheets can be divided into the regular sheaves in a manner such that the innate high-speed performance of the blade-wheel stacking system is best exhibited. For intermittent dividing operation of the separator, it is necessary to locate the separator in the receiving position at the time of division, and in the stand-by position in other cases. According to the present invention, when the dividing operation is ended, the separator is retreated in the axial direction and rotated to the position beside the stand-by position, and is then advanced to the stand-by position. Without regard to the construction of the feeding means, therefore, the separator can be transferred from the receiving position to the stand-by position. Thus, unlike the conventional separator, which is moved to the stand-by position through the spacing between the paper sheets fed by the feeding means, the separator of the invention can be moved slowly to the stand-by position. This leads to a reduction in power consumption required for the transfer of the separator to the stand-by position.

DETAILED DESCRIPTION OF THE PREFERRED EMBODIMENT

An embodiment of the present invention will now be described in detail with reference to the accompanying drawings.

Figure 1:
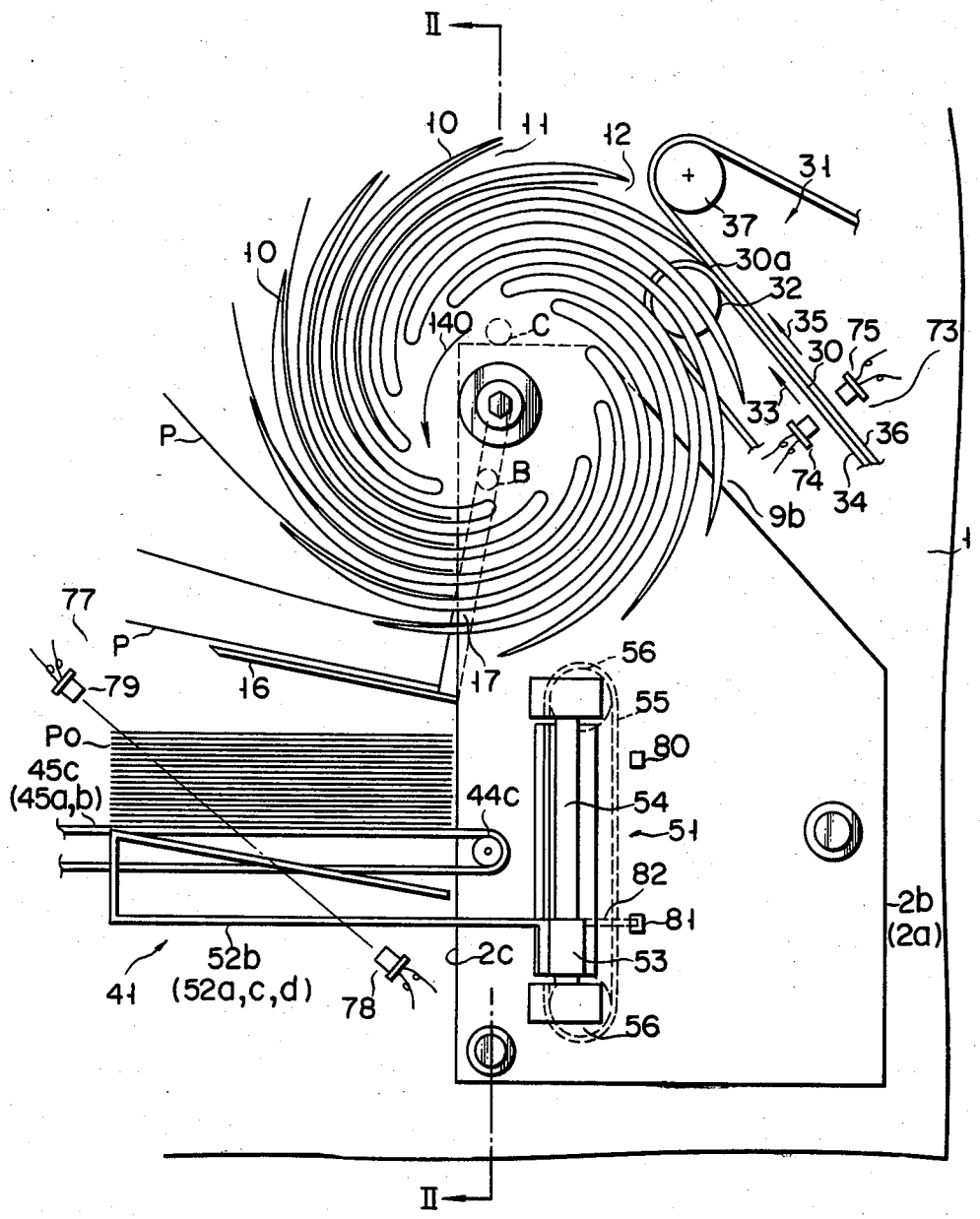
FIG. 1 is a broken away, side view showing the principal part of a paper sheet stacking apparatus according to one embodiment of the present invention.
Figure 2:
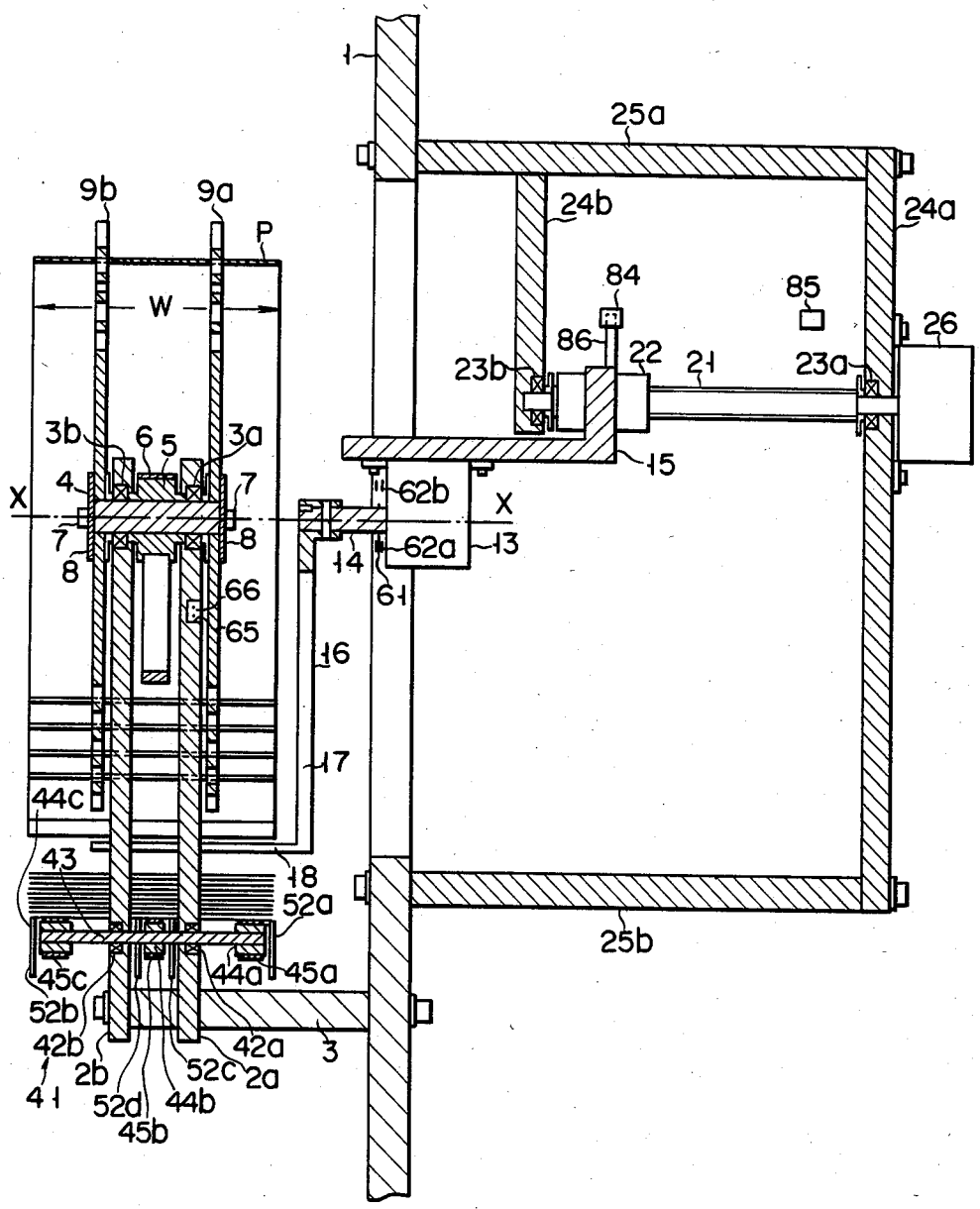
FIG. 2 is a sectional view of the apparatus taken along line II—II of FIG. 1.

FIG. 1 is a side view, partially in section, showing a stacking apparatus according to the one embodiment of the invention, and FIG. 2 is a sectional view taken along line II—II of FIG. 1.

In FIGS. 1 and 2, numeral 1 designates a base plate positioned vertically. A parallel pair of support plates 2*a* and 2*b* are arranged at a predetermined space on one side of the base plate 1, extending parallel thereto. The support plates 2*a* and 2*b* are fixed at the lower portion thereof to the base plate 1 by means of a support member 3. Each of the support plates 2*a* and 2*b* is formed so that the lower portion of its left end face (in FIG. 1) constitutes a vertical surface 2*c*.

Bearings 3*a* and 3*b* are coaxially buried in the upper portions of the support plates 2*a* and 2*b*, respectively. The axis of the bearings 3*a* and 3*b* extends at right angles to the lateral face of the base plate 1. A shaft 4 is rotatably supported by the inner peripheral edges of the bearings 3*a* and 3*b*. A pulley 5 is fixed on the shaft 4 (FIG. 2), positioned between the support plates 2*a* and 2*b*. One end side of an endless belt 6 is passed around the pulley 5, while the other end side is coupled to a drive source (not shown). Thus, the shaft 4 is rotated in the direction of an arrow 140 around the axis of rotation X—X (FIG. 2) at constant speed. A pair of blade wheels 9*a* and 9*b* for paper sheet stacking are coaxially fixed individually to both end portions of the shaft 4 by means of their corresponding sets of fixtures 7 and 8. The distance between the blade wheels 9*a* and 9*b* is shorter than the width W of paper sheets P to be stacked. As shown in FIG. 1, a plurality of elongate blades 10, which extend outward from the central portion of the blade wheel 9*b* (9*a*) in the direction opposite to the rotating direction thereof, describing e.g., an involute curve, are arranged along the circumference of the blade wheel 9*b* (9*a*) with slender spaces 11 between them. The blade wheels 9*a* and 9*b* are fixed individually to the shaft 4 in a manner such that their slender spaces 11 are aligned along the shaft 4.

Figure 3:
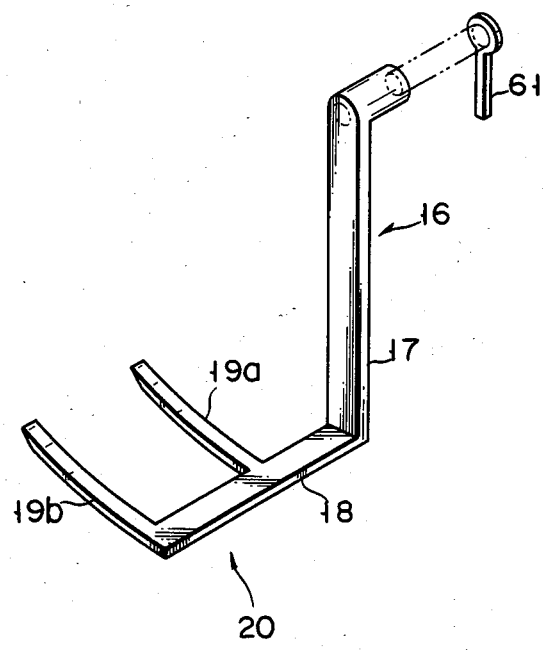
FIG. 3 is a perspective view of a separator of the apparatus.

Beside the shaft 4, a pulse motor 13 is provided on the side of the base plate 1 so that its drive shaft 14 is coaxial with the shaft 4. The pulse motor 13 is supported by a support member 15. A separator 16 is fixed to the drive shaft 14 of the pulse motor 16. As shown in FIGS. 2 and 3, the separator 16 is formed of an arm portion 17 which extends radially from the drive shaft 14 in parallel with the outer face of the blade sheet 9*a*, going beyond the outer peripheral edges of the blade wheels 9*a* and 9*b*, a bottom portion 18 which extends parallel to the shaft 4 from the distal end of the arm portion 17 toward the blade wheels 9*a* and 9*b*, and a receiving portion 20 consisting of two extending portions 19*a* and 19*b* which extend from the bottom portion 18 over a distance substantially half the length of the paper sheets P at substantially right angles to both the arm portion 17 and the bottom portion 18 and in the direction opposite to the rotating direction of the blade wheels 9*a* and 9*b*. As shown in FIG. 2, the support member 15 is supported by a nut 22 which is fitted on a screw rod 21 extending along a line parallel to the shaft 4. The screw rod 21 is rotatably supported at each end on support frames 24*a* and 24*b* by means of bearings 23*a* and 23*b*. The support frames 24*a* and 24*b* are fixed to the base plate 1 by means of support frames 25*a* and 25*b*. One end of the screw rod 21 is coupled to the drive shaft of a motor 26, which is fixed on the outer face of the support frame 24*a*.

As shown in FIG. 1, feeding means or a belt mechanism 31 for feeding the paper sheets P into the spaces 11 of the blade wheels 9*a* and 9*b* is provided between the top portions of the blade wheels 9*a* and 9*b*. The belt mechanism 31 is mainly composed of a pulley 32 disposed between the blade wheels 9*a* and 9*b* with its axis parallel to the shaft 4 (FIG. 2); lower belts 34 passed around the pulley 32 in two rows that are arranged at right angles to the drawing plane of FIG. 1 and adapted to be driven in the direction of an arrow 33 by the pulley 32; upper belts 36 overlapping the top surfaces of the lower belts 34 up to the position of the pulley 32 and adapted to be guided in the direction of an arrow 35 to carry the paper sheets P at a section 30 wherein the belts 34 and 36 overlap one another; and a pulley 37 whereby the upper belts 36 are turned at a point beyond the pulley 32 on the extension of the section 30. Thus, the terminal end of the overlap section 30, that is, an outlet 30*a* for the paper sheets P, is located inside the outer peripheral edges of the blade wheels 9*a* and 9*b*. The pulleys 32 and 37 are supported on the base plate 1 by means of support members (not shown). The lower and upper belts 34 and 36 are driven at the same speed higher than the peripheral speed of the blade wheels 9*a* and 9*b*.

A main stacking unit 41 is disposed under the blade wheels 9*a* and 9*b*. As shown in FIG. 2, the main stacking unit 41 comprises bearings 42*a* and 42*b* coaxially buried in the lower portions of the support plates 2*a* and 2*b*, respectively, arranged on a line parallel to the shaft 4; a shaft 43 rotatably supported by the inner rings of the bearings 42*a* and 42*b*; pulleys 44*a*, 44*b* and 44*c* fixed on the shaft 43; a set of belts including bets 45*a*, 45*b* and 45*c* passed around the pulleys 44*a*, 44*b* and 44*c*, respectively, and extending horizontally to the left of FIG. 1; and a motor (not shown) for driving these belts in the manner mentioned later.

An auxiliary stacking unit 51 is disposed beside the main stacking unit 41. The auxiliary stacking unit 51 comprises support arms 52*a*, 52*b*, 52*c* and 52*d* (FIG. 2) extending substantially parallel to the belts 45*a*, 45*b* and 45*c* from the side of the support plates 2*a* and 2*b* and turned up and folded back downwardly so that its extreme end portion is located on the side of the support plates 2*a* and 2*b*, a shown in FIG. 1, a coupling member (not shown) coupling the bottom portions of these support arms in a roundabout manner; a guide bar 54 for vertically guiding an end portion 53 on the side of the support plate 2*b* at the bottom portion of the support arm 52*b*, a belt 55 supported by a pair of pulleys 56 and coupled to the end portion 53, whereby the end portion 53 is moved up an down along the guide bar 54 to move all the support arms 52*a* to 52*d* vertically; and a motor (not shown) for driving the belt 55 in the manner mentioned later.

Figure 4:
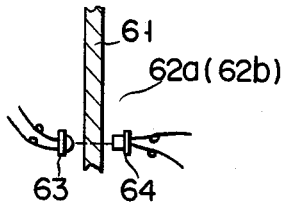
FIG. 4 is a diagram for illustrating the configuration of a separator detector of the apparatus.
Figure 5:
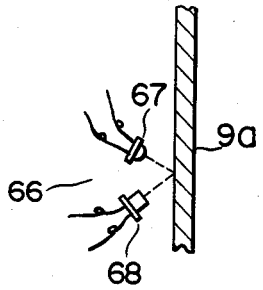
FIGS. 5 and 6 are diagrams for illustrating the configuration of a pulse generator of the apparatus.
Figure 6:
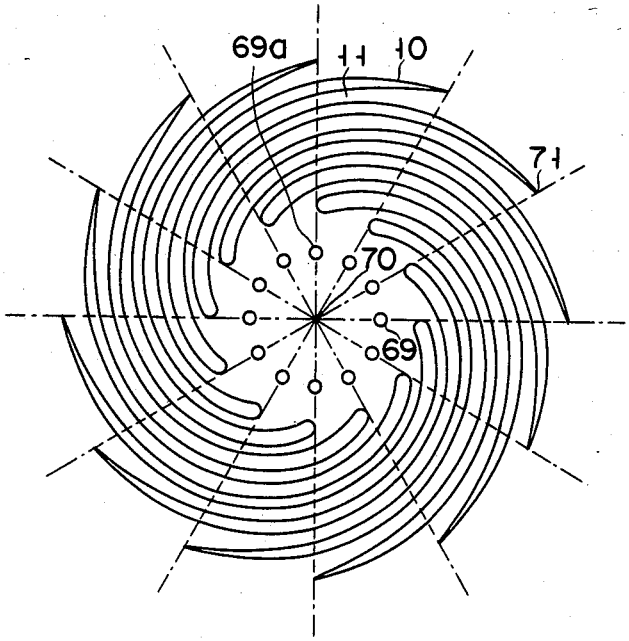

One end portion of a bar 61 for detecting the position of the separator 16 is fixed to the proximal portion of the drive shaft 14 of the pulse motor 13. As shown in FIG. 3, the bar 61 has a circumferential width narrower than that of the arm portion 17 of the separator 16, and is fixed to the drive shaft 14 so as to extend in the same direction as the arm portion 17. Separator detectors 62*a* and 62*b* for detecting the existence of the bar 61 in an uncontacted manner are fixed to the side face of the pulse motor 13. As shown in FIG. 4, the separator detectors 62*a* and 62*b* are each formed of a photocoupler including a light emitting element 63 and a light receiving element 64 which face in alignment with each other. The photocoupler delivers a low-level output signal when light incident on the light receiving element 64 is intercepted by the bar 61 interposed between the two elements 63 and 64. In other situations, the photocoupler delivers a high-level output signal. In FIG. 1, the separator detector 62*a* is located in a position B indicated by a broken line. The separator detector 62*a* delivers a low-level output signal when the bar 61 or the arm portion 17 of the separator 16 reaches the position B. The separator detector 62*b* is attached to a position C indicated by a broken-line circle, and delivers a low-level signal when the arm portion 17 of the separator 16 reaches the position C. A depression 65 (FIG. 2) is formed in that surface of the support plate 2*a* which faces the inner face of the blade wheel 9*a*. A pulse generator 66 for generating pulses in synchronism with the rotation of the blade wheels 9*a* and 9*b* is fitted in the depression 65. As shown in FIG. 5, the pulse generator 66 is mainly composed of a photocoupler which includes a light emitting element 67 for projecting light at a given angle on the inner face of the blade wheel 9*a*, and a light receiving element 68 for receiving reflected light from the inner face of the blade wheel 9*a*. In FIG. 5, the depression 65 is omitted for the simplicity of illustration. As shown in FIG. 6, a plurality of perforations 69 are circumferentially arranged in that portion of the blade wheel 9*a* which receives the projected light. The individual perforations 69 are located on lines which connect the center 70 of the blade wheel 9*a* and the tips Q of their corresponding blades 10. The pulse generator 66 delivers an output pulse when the light from the light emitting element 67 has passed through the perforations 69 and there is no reflected light to be projected on the light receiving element 68. A sheet number detector 73 is disposed at that portion of the overlap section 30 of the belt mechanism 31 near the paper outlet 30*a*. The sheet number detector 73 detects the paper sheets P passing between the lower and upper belts 34 and 36 of the belt mechanism 31, and delivers an output pulse when a predetermined number of paper sheets to be distributed in a sheaf plus another paper sheet have passed the detector 73, that is, when the first one among the predetermined number of paper sheets to be alotted has passed the detector 73. The principal part of the sheet number detector 73 is formed of a light emitting element 74 and a light receiving element 75, which vertically face each other with the overlap section 30 of the belt mechanism 31 therebetween, and are located halfway between each parallel pair of belts 34 or 36.

As shown in FIG. 1, a stacking detector 77 is disposed beside the main stacking unit 41. The stacking detector 77 includes a light emitting element 78 and a light receiving element 79 facing each other on an oblique optical axis which extends within a plane between the belts 45*b* and 45*c* substantially at a right angle to the shaft 4 and is declined to the right of FIG. 1. The detector 77 delivers an output signal when the light receiving element 79 receives light emitted from the light emitting element 78. As shown in FIG. 1, an upper detector 80 and a lower detector 81 are for detecting the respective upper and lower positions of the support arms 52*a*, 52*b*, 52*c* and 52*d*. Like the separator detectors 62*a* and 62*b*, the upper and lower detectors 80 and 81 are each formed of a photocoupler, and delivers low-level outputs when a bar 82 protruding from the end portion 53 of the support arm 52*b* intercepts the optical path. In other situations, the detectors 80 and 81 deliver high-level outpus signals. When the output of the upper or lower detector 80 or 81 goes low, the support arms 52*a* to 52*d* are brought to the height mentioned later. Detectors 84 and 85 for detecting the position of the nut 22 are provided beside the screw rod 21 (FIG. 2). For convenience, the detectors 84 and 85 will hereinafter be referred to as left and right detectors, respectively. Like the separator detectors 62*a* and 62*b*, the left and right detectors 84 and 85 are each formed of a photocoupler, and deliver low-level outputs when a lever 86 protruding from the nut 22 intercepts the optical path. In other situations, the detectors 84 and 85 deliver high-level outputs. When the optical path of the left detector 84 is intercepted by the bar 86, the receiving portion 20 of the separator 16 is located outside the outer peripheral edges of the blade wheels 9*a* and 9*b* and in the most deeply overlapped relation as viewed along the axis of the blade wheels 9*a* and 9*b*, while the arm portion 17 is located off and outside the facing side edges of the paper sheets P held in the spaces 11. When the optical path of the right detector 85 is intercepted by the bar 86, on the other hand, the receiving portion 20 is located in its right end position, as in FIG. 2, farthest from the outer peripheral edges of the blade wheels 9*a* and 9*b*. In this state, as described later, the receiving portion 20 never prevents the paper sheets P from being forced out and dropped freely from the blade wheels 9*a* and 9*b*.

Figure 7:
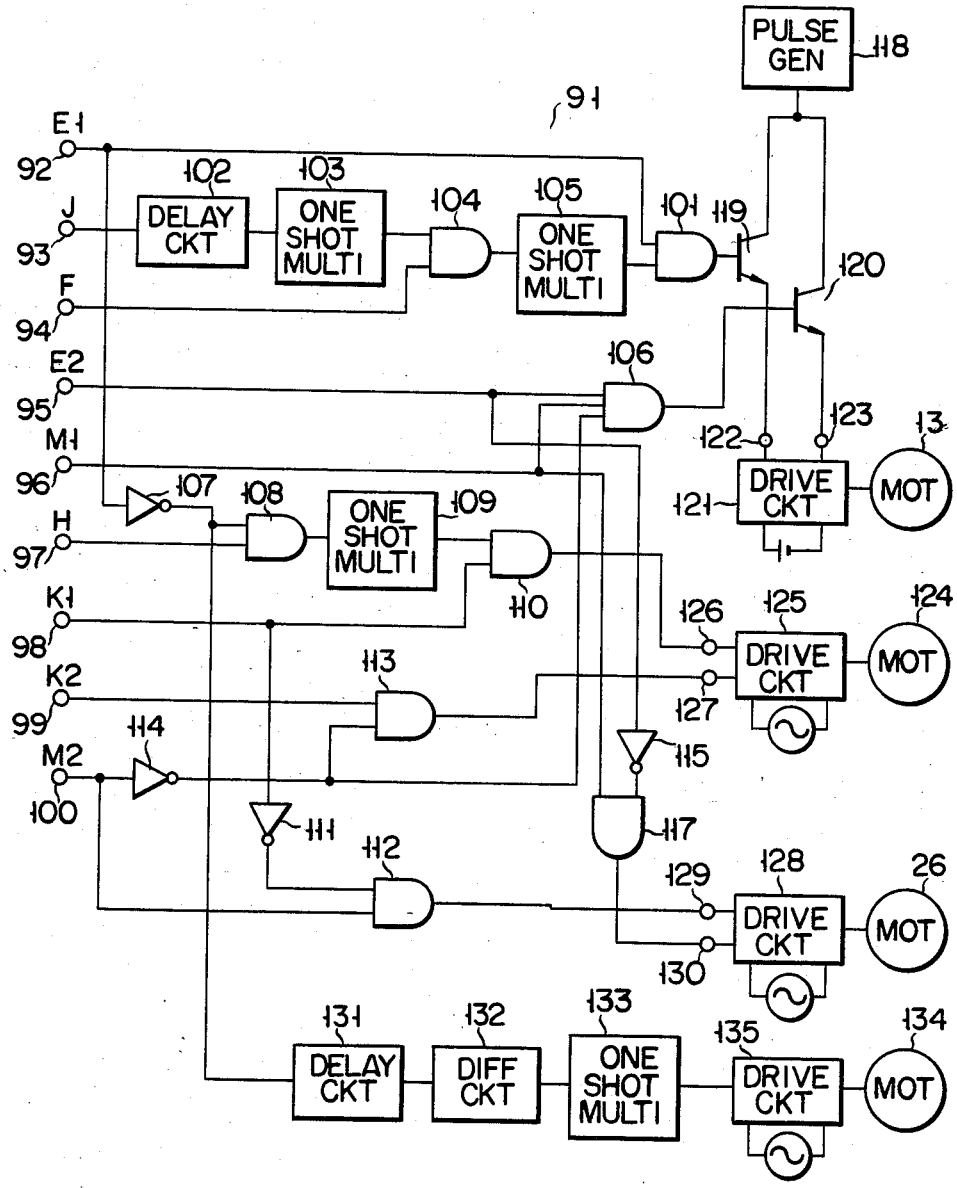
FIG. 7 is a diagram for illustrating the configuration of a control unit of the apparatus.
Figure 8:
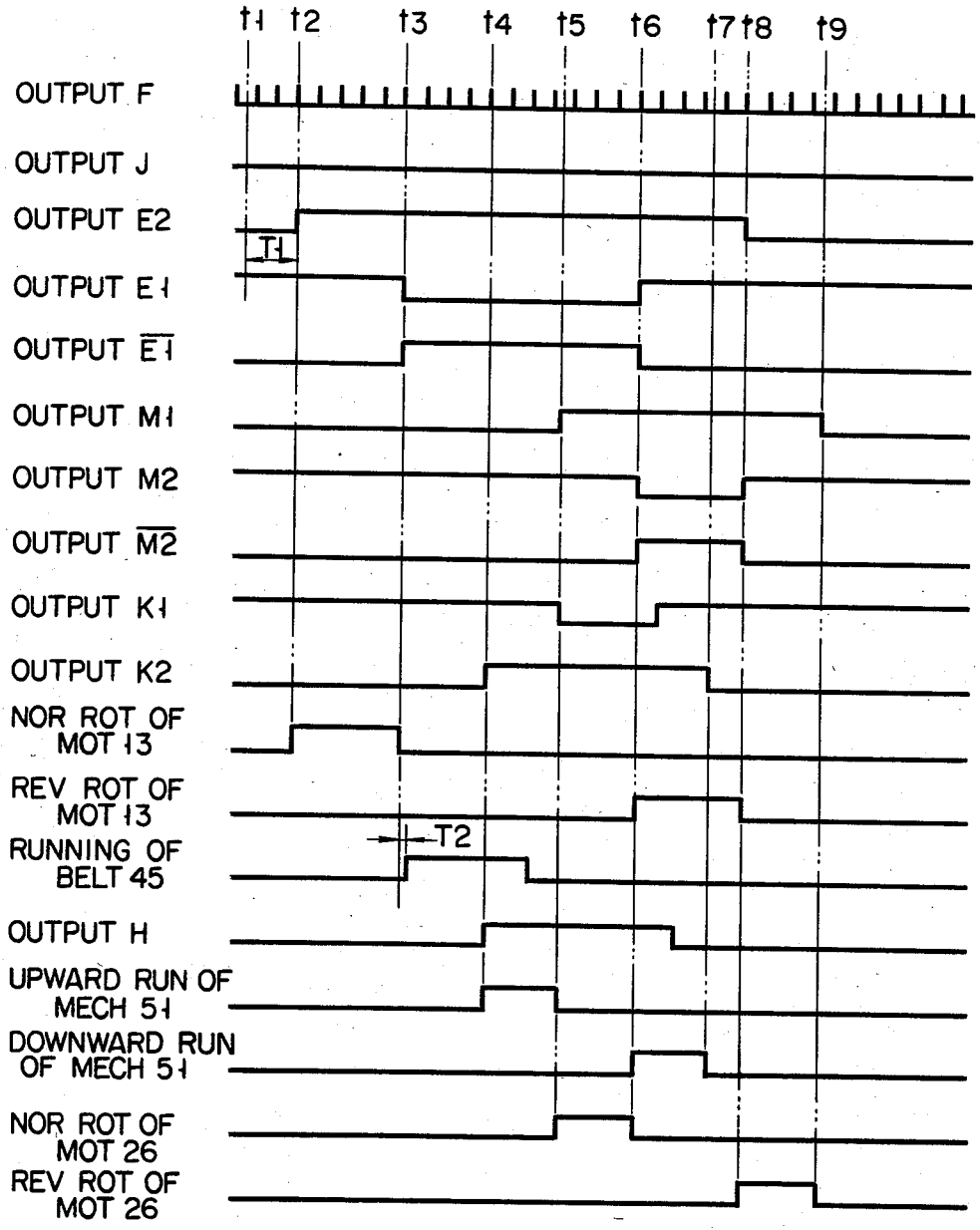
FIGS. 8 to 17 are diagrams for illustrating the operation of the apparatus.

The outputs E1 and E2 of the separator detectors 62*a* and 62*b* (FIG. 4), output F of the pulse generator 66 (FIG. 5), output J of the sheet number detector 73 (FIG. 1), output H of the stacking detector 77 (FIG. 1), outputs K1 and K2 of the upper and lower detectors 80 and 81 (FIG. 1), and outputs M1 and M2 of the left and right detectors 84 and 85 (FIG. 2) are supplied to a control unit 91. As shown in FIG. 7, the control unit 91 has nine input terminals 92 to 100. The output E1 of the separator detector 62*a* is applied to the input terminal 92, and is then fed to one input terminal of an AND gate 101. The output J of the sheet number detector 73 is applied to the input terminal 93, and is then fed to one input terminal of an AND gate 104 through a delay circuit 102 set to the delay time mentioned later and a one-shot multivibrator 103. The output F of the pulse generator 66 is applied to the input terminal 94, and is then fed to the other input terminal of the AND gate 104. The output of the AND gate 104 is supplied to the other input terminal of the AND gate 101 through a one-shot multivibrator 105. The outputs E2 and M1 of the separator detector 62*b* and the left detector 84 are applied to the input terminals 95 and 96, respectively, and are then supplied to the first and second input terminals of an AND gate 106. The output H of the stacking detector 77 is applied to the input terminal 97. The output H and a signal E1, obtained by inverting the output $\overline{E1}$ by an inverter 107, are fed to an AND gate 108. The output of the AND gate 108 is supplied to one input terminal of an AND gate 110 through a one shot multivibrator 109. The output K1 of the upper detector 80 is applied to the input terminal 98, and is then fed to the other input terminal of the AND gate 110 and also to one input terminal of an AND gate 112 through an inverter 111. The output K2 of the lower detector 81 is applied to the input terminal 99, and is then fed to an AND gate 113. The output M2 of the right detector 85 is applied to the input terminal 100, and is then fed to the other input terminal of the AND gate 112. Further, a signal $\overline{M2}$ obtained by inverting the output M2 by an inverter 114 is supplied to the other input terminal of the AND gate 113 and a third input terminal of the AND gate 106. The output M1 and a signal $\overline{E2}$, obtained by inverting the output E2 by an inverter 115, are fed to an AND gate 117. The control unit 91 comprises a pulse generator 118 for delivering a pulse output with the period mentioned later. The output terminal of the pulse generator 118 is connected to a forward rotation control terminal 122 and a reverse rotation control terminal 123 of a drive circuit 121 for driving the pulse motor 13 through transistors 119 and 120, respectively. The outputs of the AND gates 101 and 106 are supplied to the bases of the transistors 119 and 120, respectively. Also, the output of the AND gate 110 is supplied to a forward rotation control terminal 126 of a drive circuit 125 for a motor 124 for driving the belt 55 of the auxiliary stacking unit 51. The output of the AND gate 113 is supplied to a reverse rotation control terminal 127 of the drive circuit 125. The output of the ANd gate 112 is fed to a forward rotation control terminal 129 of a drive circuit 128 for the motor 26, while the output of the AND gate 117 is applied to a reverse rotation control terminal 130 of the circuit 128.

The output of the inverter 107 is supplied through a delay circuit 131 to a differentiating circuit 132 for differentiating the rise of the output of the delay circuit 131. The output of the differentiating circuit 132 is supplied as a drive signal to a one-shot multivibrator 133, whose output is supplied as a control signal to a drive circuit 135 for a motor 134 for driving the belts 45*a*, 45*b* and 45*c* of the stacking unit 41.

Referring now to FIGS. 8 to 17, there will be described the operation of the paper sheet stacking apparatus with the above-mentioned construction.

First suppose 1,200 paper sheets P are to be processed on the apparatus every minute. On this supposition, the running speed of the belt mechanism 31 and the speed of feeding of the paper sheets P to the mechanism 31 are set so that the time interval, which elapses from the instant that the forward edge of one paper sheet P carried by the belt mechanism 31 passes a certain spot until the forward edge of a subsequent paper sheet P reaches that spot, is 50 milliseconds. Suppose the time interval, which elapses from the instant that the backward edge of the first paper sheet P passes the predetermined spot until the forward edge of the second paper sheet P reaches the spot, is 25 milliseconds. In order to meet these conditions, according to the present embodiment, the rotational frequency of the blade wheels 9*a* and 9*b* is set as follows. Since the slender spaces 11 used in this embodiment are twelve in number, the rotation angle $\alpha$ for each space 11 is 30°. Therefore, it is necessary only that the blade wheels 9*a* and 9*b* rotate through an angle of 30° in 50 miliseconds. Thus, the rotary speed n of the blade wheels 9*a* and 9*b* is set to 100 rpm. Namely, the drive source (not shown) rotates the blade wheels 9*a* and 9*b* in the direction of the arrow 140 of FIG. 1 at 100 rpm, and drives the belts 34 and 36 in the directions of the arrows 33 and 35, respectively, in compliance with the aforesaid conditions.

Figure 9:
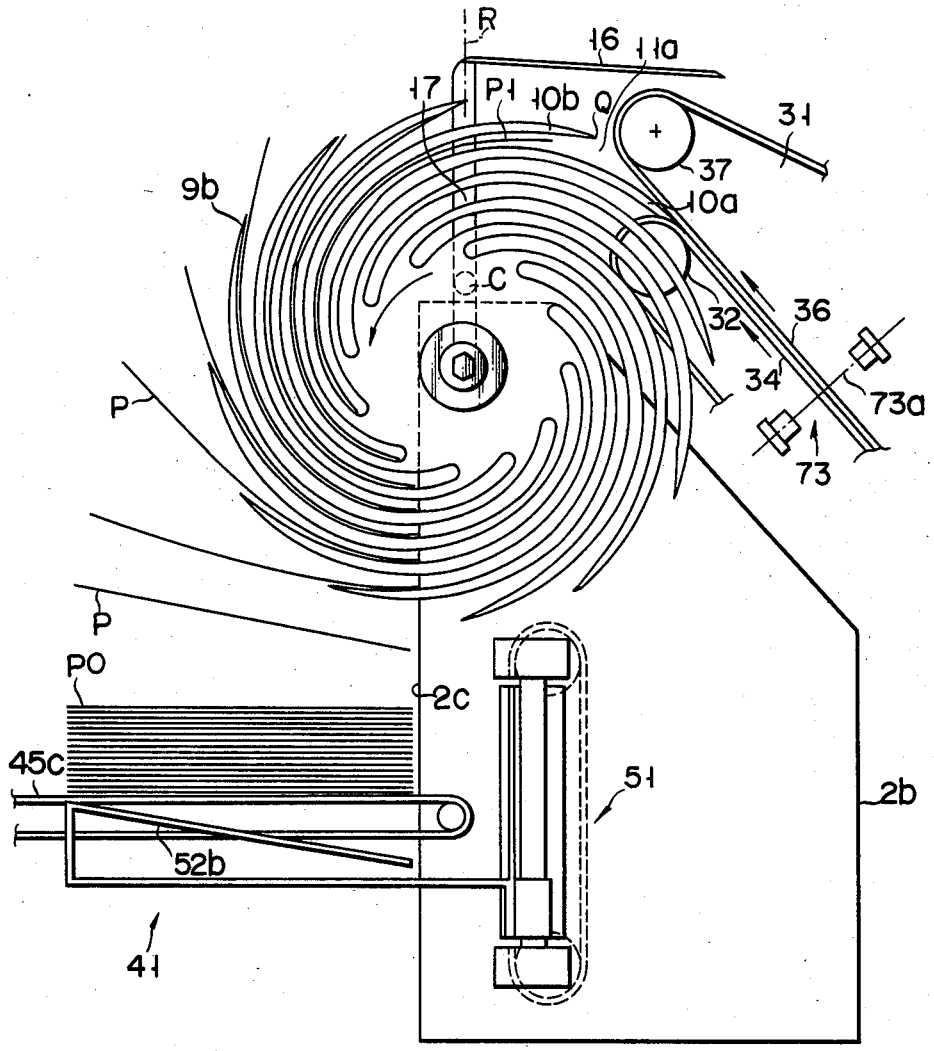
Figure 10:
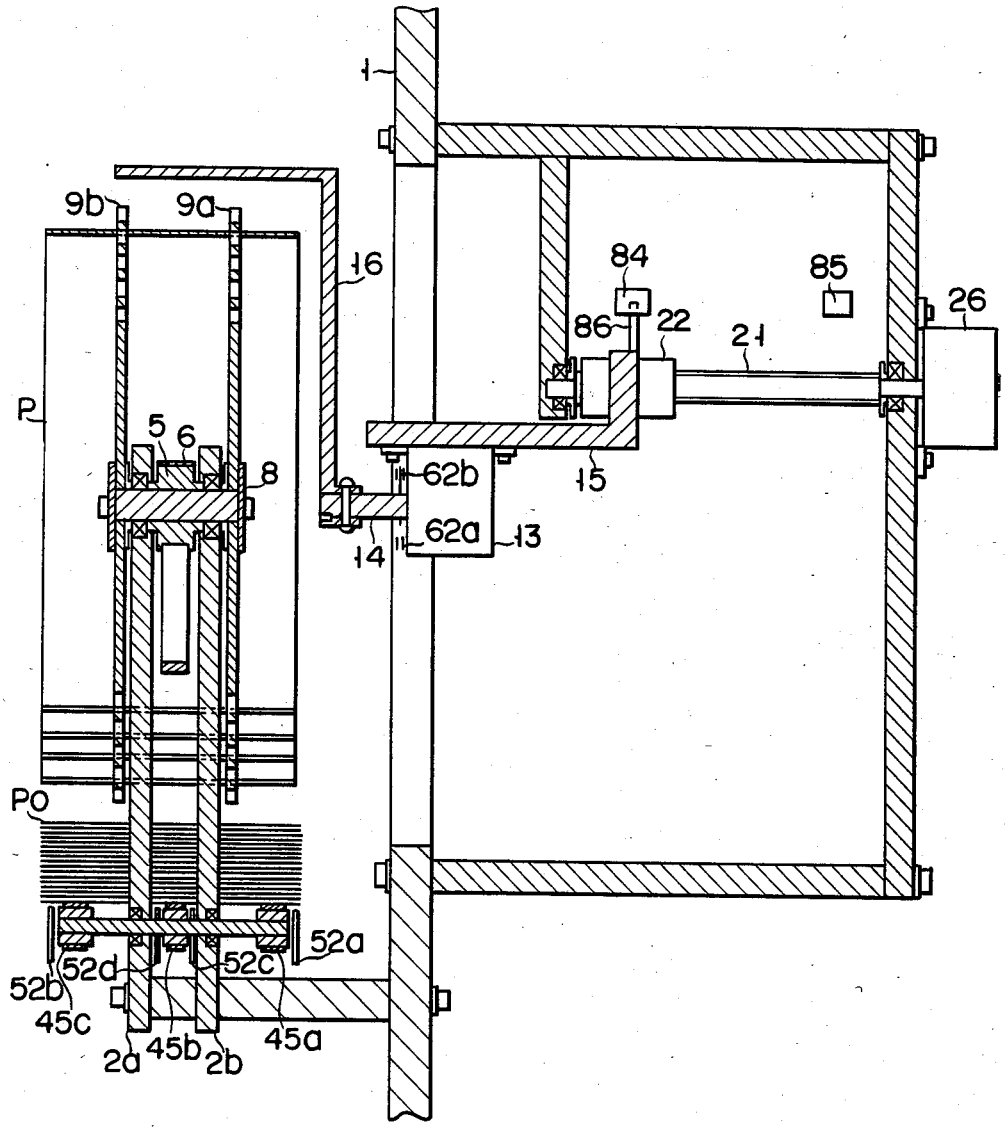

Now let it be supposed that the support arms 52*a* to 52*d* (only 52*d* is illustrated) of the auxiliary stacking unit 51 are located below the upper path portions of the belts 45*a*, 45*b* and 45*c* (only 45*c* is illustrated), as shown in FIGS. 1 and 9, i.e., the bar 82 is at the height to intercept the optical path of the lower detector 81 (FIG. 1), and that the separator 16 is located in the position shown in FIGS. 9 and 10, i.e., the optical paths of the left detector 84 and the upper separator detector 62*b* are intercepted by the bars 86 and 61, respectively. In the position shown in FIGS. 9 and 10, the arm portion 17 of the separator 16 extends substantially vertically upward, so that the separator 16 prevents neither the supply of the paper sheets P to the blade wheels 9*a* and 9*b* nor the natural or automatic dropping of the paper sheets P discharged from the blade wheels 9*a* and 9*b*. This position will hereinafter be referred to as the stand-by position of the separator 16. In this stand-by position, the position of the left detector 84 and the axial position of the separator 16 have the aforesaid relationship, and the arm portion 17 of the separator 16 is located outside the facing side edges of the paper sheets P held in the spaces 11 of the blade wheels 9*a* and 9*b*. Since the receiving portion 20 is located beyond the outer peripheral edges of the blade wheels 9*a* and 9*b*, the separator 16 is kept from touching the paper sheets P, which are delivered from the paper outlet 30*a* (FIG. 1) of the belt mechanism 31 into the spaces 11 of the blade wheels 9*a* and 9*b*. Accordingly, the paper sheets P are allowed to enter the spaces 11 as if the separator 16 did not exist. Before the paper sheets P are entirely housed in the individual spaces 11, they are decelerated by a frictional force which depends on the shape and surface condition of the spaces 11. That position of the blade wheels 9*a* and 9*b* which provides a situation such that the opening 12 (FIG. 1) of one of the spaces 11 is in front of the paper outlet 30*a*, ready to receive a paper sheet P, will hereinafter be referred to as the paper receiving position of the blade wheels 9*a* and 9*b*. The paper sheets P contained in the spaces 11 rotate as the blade wheels 9*a* and 9*b* rotate. When the separator 16 makes a substantially half turn from the stand-by position, the forward edges of the paper sheets P abut against the left end faces 2*c* (FIG. 1) of the support plates 2*a* and 2*b* between the blade wheels 9*a* and 9*b*. The left end faces 2*c* serve as a stationary stop. Thus, end-faces 2*c* will hereinafter be also referred to as the stationary stop or stop simply. Since the blade wheels 9*a* and 9*b* continue to rotate even though the paper sheets P are stopped, each paper sheet P in each individual space 11 gradualy comes out of the space 11 with its backward edge forward. After the whole body of the paper sheet P is removed from the space 11, the paper sheet P automatically falls in a substantially horizontal position onto the predetermined place of the belts 45*a*, 45*b* and 45*c* of the main stacking unit 41. Thus, a sheaf Po of paper sheets P is formed on the belts, rapidly increasing its thickness as a sheet is added thereto every 50 milliseconds.

In this state, the optical path of the photocoupler constituting the upper separator detector 62*b* is intercepted by the bar 61, so that the output E2 of the separator detector 62*b* is maintained at the low level. On the other hand, there is no obstacle in the optical path of the lower separator detector 62*a*, so that the output E1 of the separator detector 62*a* is maintained at the high level. Since the perforations 69 are arranged in the aforementioned manner, the pulse generator 66 delivers the pulsating output F with a period of 50 milliseconds as the blade wheels 9*a* and 9*b* rotate. The output F is supplied to the AND gate 104. The outputs K2 and M1 of the lower and left detectors 81 and 84 are maintained at the low level, and the outputs K1 and M2 of the upper and right detectors 80 and 85 at the high level.

In a state such that the paper sheets P are stacked one after another in the aforesaid manner, if it is detected at a time t1 that the rear edges of a predetermined number (e.g., 100) of paper sheets pulse another one have passed the optical axis connecting the light emitting element 74 and the light receiving element 75, then the sheet number detector 73 delivers the pulsating output J. The predetermined number means the number of the paper sheets included in each regular sheaf. The output J is fed to one input terminal of the AND gate 104 through the delay circuit 102 and the one-shot multivibrator 103 of the control unit 91 shown in FIG. 7. A delay time T1 of the delay circuit 102 is set as follows. If a paper sheet P1 just inserted in a space 11a between blades 10*a* and 10*b*, as shown in FIG. 9, is a 101st one, then the delay time T1 is equivalent to the time interval which elapses from the time t1 when the rear edge of the paper sheet P1 crosses the optical axis 73*a* of the sheet number detector 73 until the tip Q of the blade 10*b* directly before the space 11*a* reaches the position just beside the center line R of the arm portion 17 of the separator 16 as viewed along the axis of the blade wheels 9*a* and 9*b*. The pulse generator 66 is actuated to deliver the output F every time the edge of a blade 10 of each of the blade wheels 9*a* and 9*b* crosses the center line R of the stopped separator 16. Therefore, when the tip Q of the blade 10*b* shown in FIG. 10 crosses the center line R, the AND gate 104 is simultaneously supplied at a time t2 with the pulsating signal F then delivered from the pulse generator 66 and a signal delivered from the sheet number detector 73. The signal from the detector 73 is delayed for the delay time T1. Accordingly, the AND gate 104 is opened, so that the one-shot multivibrator 105 is driven. At the time t2, the output E1 of the separator detector 62*a* is at the high level, so that the AND gate 101 is opened to turn on the transistor 119. Thus, the output pulse of the pulse generator 118 (FIG. 7) is supplied as a forward rotation control signal to the drive circuit 121 via the transistor 119. As a result, the pulse motor 13 is rotated to rotate the separator 16 in the counterclockwise direction of FIG. 11 at the same speed as the blade wheels 9*a* and 9*b*. The blade wheels 9*a* and 9*b* and the separator 16 are rotated at the same speed because the pulse generators 118 and 66 are designed so as to deliver output pulses with the same period. Accordingly, the separator 16 rotates in the same direction and at the same speed as the blade wheels 9*a* and 9*b* with the center line R of its arm portion 17 positioned just beside the edge Q of the blade 10*b* on and after the time t2.

Figure 11:
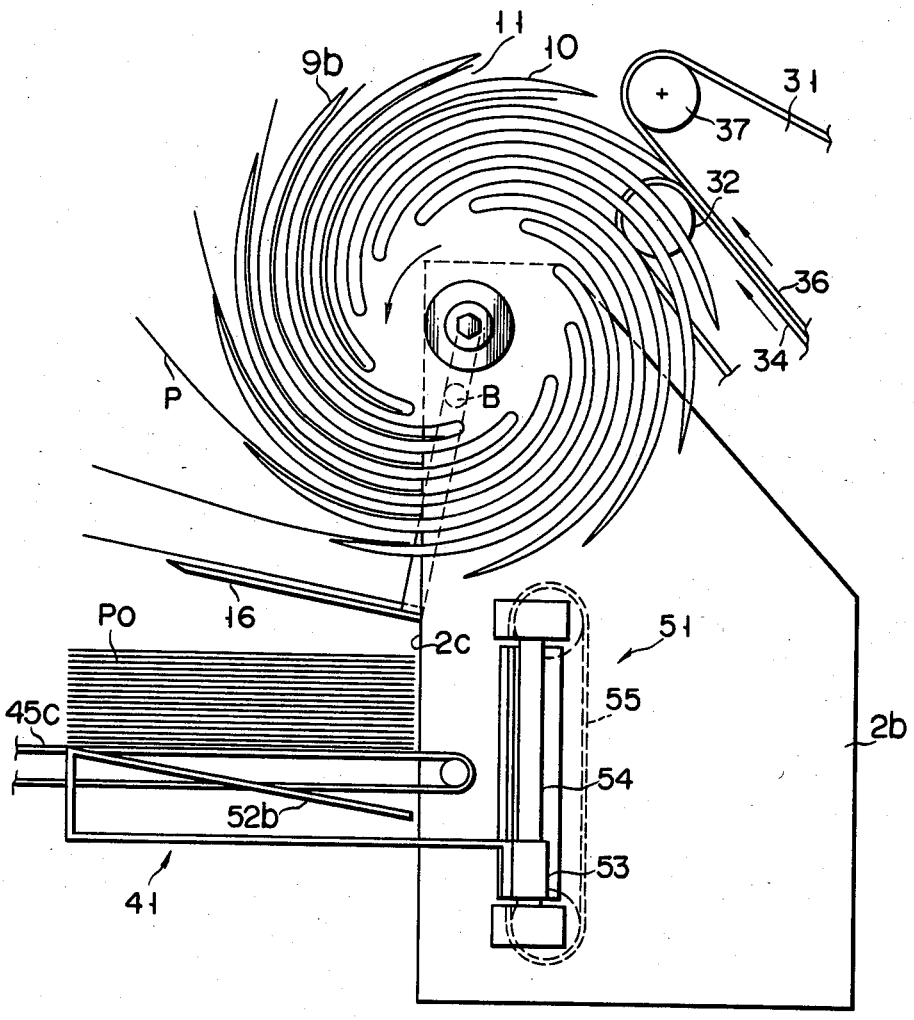
Figure 12:
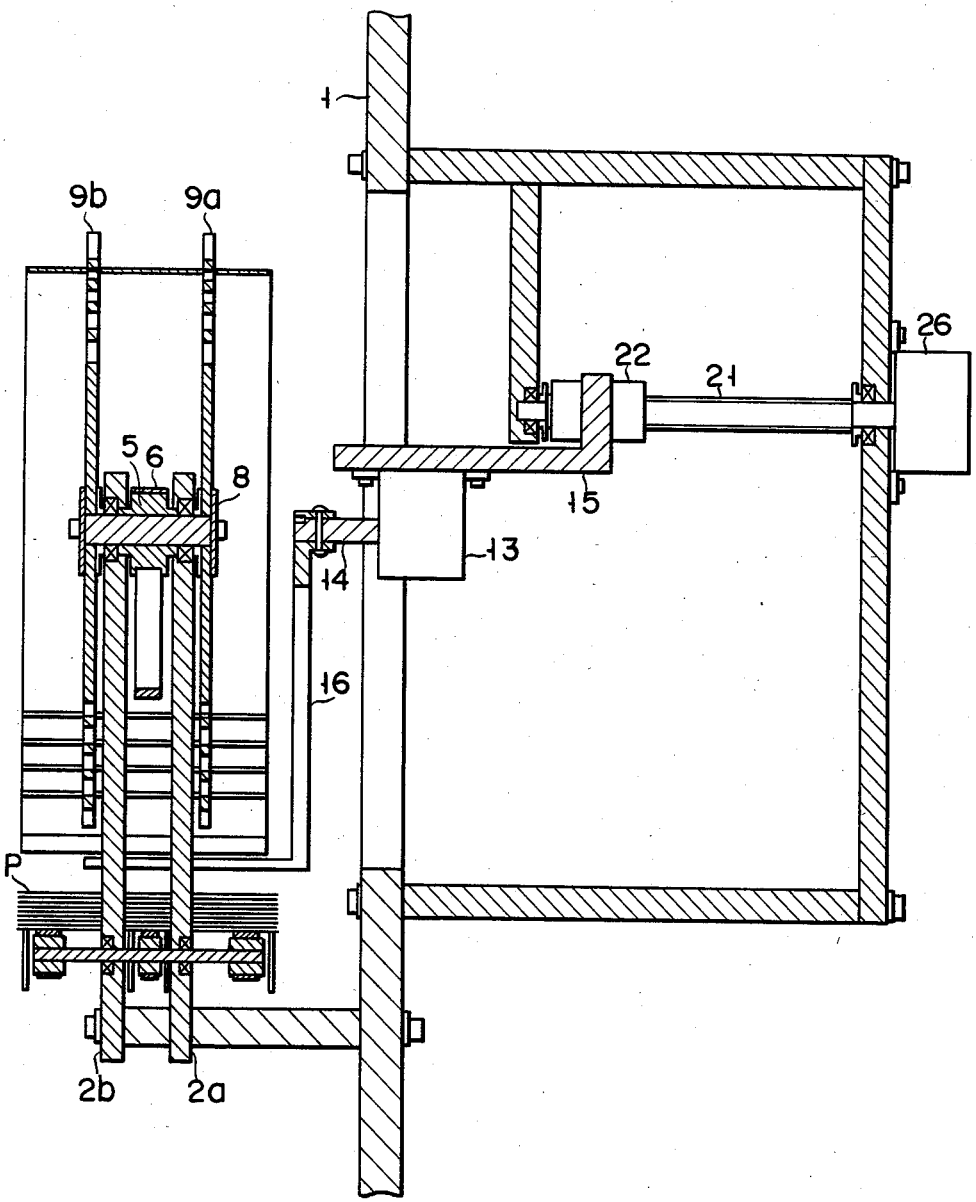

At a time t3 when the separator 16 reaches the position just beside the lower separator detector 62*a*, as shown in FIG. 11, after rotating in the aforesaid manner, the bar 61 intercepts the optical path of the photocoupler constituting the separator detector 62*a*, so that the output E1 of the separator detector 62*a* is reduced. As a result, the AND gate 101 is closed to turn off the transistor 119, thereby stopping the drive of the pulse motor 13. Thus, the separator 16 is stopped at the position shown in FIG. 11 at a time t3 of FIG. 3. During this process, the forward edge of the 101st paper sheet P1 held in the space 11*a* between the blades 10*a* and 10*b* abuts against the left end faces or stops 2*c* of the support plates 2*a* and 2*b*, and the paper sheet P1 ceases to rotate. Then, the paper sheet P1 gradually comes cut from the space 11*a* with its rear edge forward, and finally, is entirely removed from the space 11*a*. Before the separator 16 stops at the position shown in FIG. 11, it rotates with the center line R of its arm portion 17 located just beside the edge Q of the blade 10*b* as described before. Accordingly, the 101st paper sheet P1 removed from the space 11*a* is caught by the receiving portion 20 of the separator 16 without falling onto the main stacking unit 41. Thus, the 101st paper sheet P1 is completely separated from a 100th one by the receiving portion 20, and the 101st paper sheet P1 and its subsequent paper sheets are stacked one after another on the receiving portion 20.

When the separator 16 ceases to rotate in the aforesaid manner, and when the output E1 of the lower separator detector 62*a* is switched to the low level, the output $\overline{E1}$ of the inverter 107 obtained by inverting the output E1 is switched to the high level. The output $\overline{E1}$ is supplied to the delay circuit 131 and the differentiating circuit 132 for differentiating the rise of the output of the delay circuit 131. The output of the differentiating circuit 132 is supplied as a control signal to the drive circuit 135 for the motor 134 through the one-shot multivibrator 133. Thus, the motor 134 (FIG. 7) starts to rotate at a point of time somewhat delayed from the time t3, and the belts 45*a*, 45*b* and 45*c* are driven in the direction of the arrow 141 of FIG. 13 for a period of time set by the one-shot multivibrator 133, so that the sheaf Po of paper sheets P on these belts is moved away from the space under the blade wheels 9*a* and 9*b*. A delay time T2 of the delay circuit 131 is adjusted to the time interval required for the 100th paper sheet P or the last one of paper sheets P constituting a sheaf to finish falling. During such a period, the paper sheets P continue to be stacked one after another on the receiving portion 20.

Figure 13:
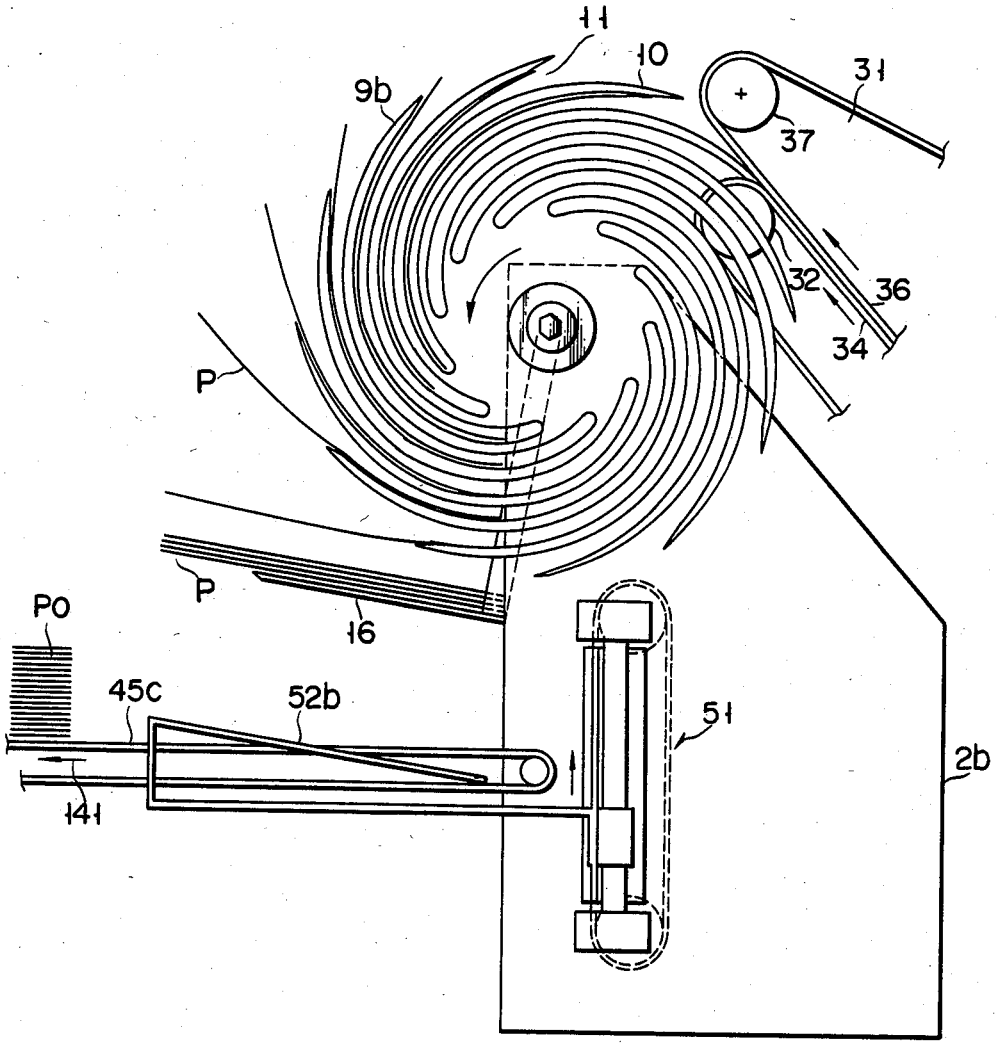
Figure 14:
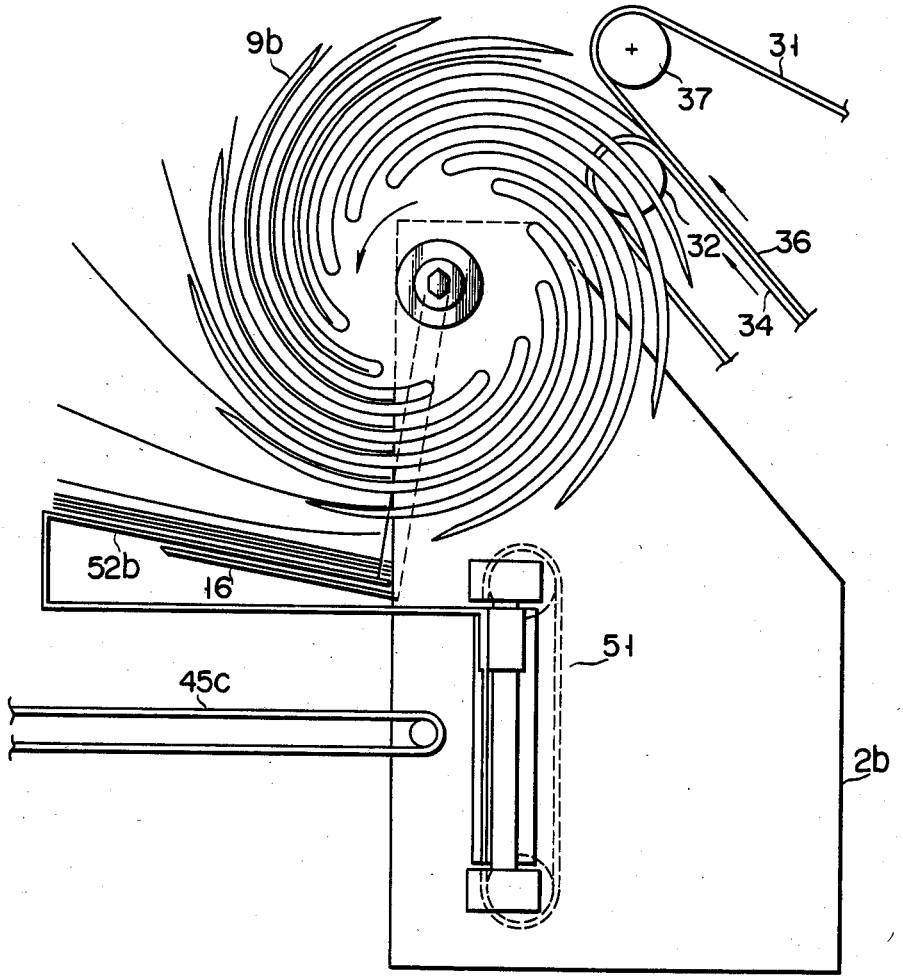

At a time t4 when the sheaf Po on the belts 45*a*, 45*b* and 45*c* are moved away from the space under the blade wheels 9*a* and 9*b* in the aforesaid manner, the stacking detector 77 is actuated, that is, the output H of the detector 77 is switched to the high level. The output H is fed to the AND gate 108. At the time t4, the output E1 is at the low level, so that the output E1 of the inverter 107 is at the high level. As a result, the AND gate 108 is opened and the one-shot multivibrator 109 is driven. At the time t4, moreover, the output K1 of the upper detector 80 is at the high level, so that the AND gate 110 is opened, and a forward rotation control signal is supplied to the drive circuit 125. Accordingly, the motor 124 rotates in the forward direction, so that the support arms 52*a* to 52*d* of the auxiliary stacking unit 51 are gradually forced up, as shown in FIG. 13. At a time t5 when the upper side portions of the support arms 52*a* to 52*d* are raised above the receiving portion 20 of the separator 16, as shown in FIG. 14, the optical path of the upper detector 80 is intercepted by the bar 82, so that the output K1 is switched to the low level. As a result, the AND gate 110 is closed. Thus, at the time t5, the motor 124 ceases to rotate. Since the support arms 52*a* to 52*d* are located above he receiving portion 20, as mentioned above, the paper sheets P having so far been supported by the receiving portion 20 are transferred to the support arms 52*a* and 52*d*. In other words, the support arms 52*a* to 52*d* bear the paper sheets P thereon in place of the receiving portion 20.

Figure 15:
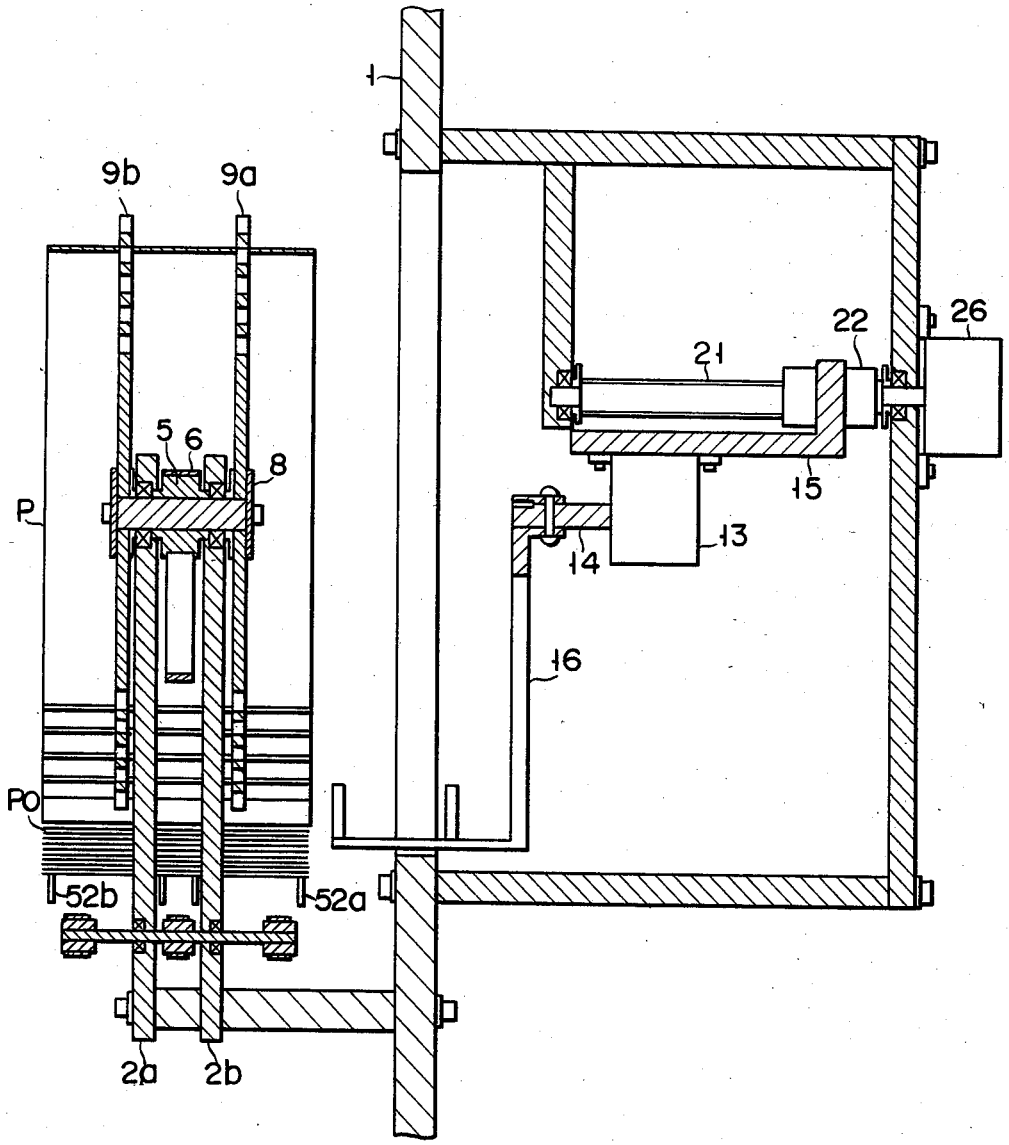

When the output K1 of the upper detector 80 is switched to the low level, moreover, the output K1 of the inverter 111 is switched to the high level. At this point of time, the output M2 of the right detector 85 is at the high level, so that the AND gate 112 is opened, allowing a forward rotation control signal to be supplied to the drive circuit 128. Thus, the motor 26 starts to rotate in the forward direction at the time t5, so that the separator 16 is moved to the right or away from the blade wheels 9*a* and 9*b*, as shown in FIG. 15. At a time t6 when the separator 16 reaches a position such that the bar 86 intercepts the optical path of the right detector 85, the output M2 of the right detector 85 is switched to the low level to close the AND gate 112. Thus, at the time t6, the motor 26 ceases to rotate. In this state, the receiving portion 20 of the separator 16 is entirely removed from the space under the blade wheels 9*a* and 9*b*, and is located in its right end position, as shown in FIG. 15.

Figure 17:
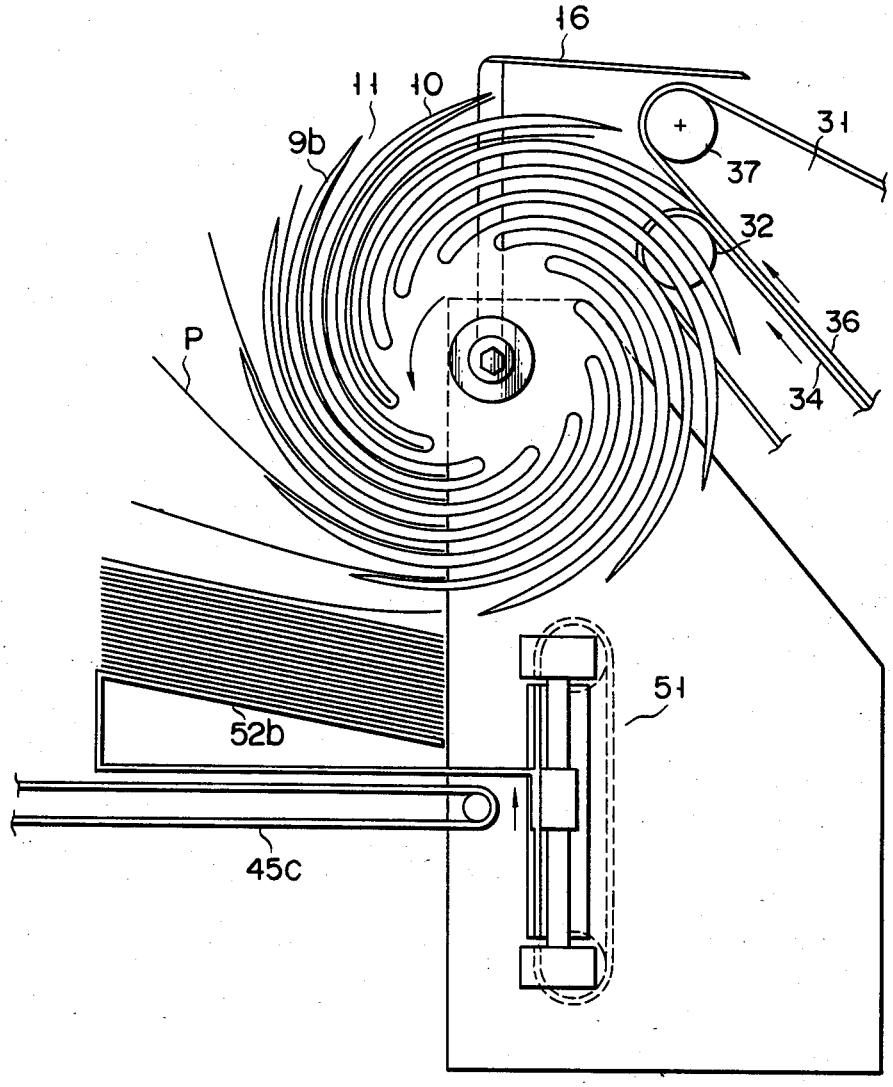

When the output M2 of the right detector 85 goes low, the output $\overline{M2}$ of the inverter 114 goes high. At this point of time, the output K2 of the lower detector 81 is at the high level, so that the AND gate 113 is opened, allowing a reverse rotation control signal to be supplied to the drive circuit 125. Thus, the motor 124 starts to rotate in the reverse direction at the time t6, so that the support arms 52*a* to 52*d* start descending, as shown in FIG. 17. At a time t7 when the support arms 52*a* to 52*d* are lowered to the position shown in FIG. 9, the output K2 of the lower detector 81 is switched to the lower level, so that the AND gate 113 is closed to stop the rotation of the motor 124. At the time t7, therefore, the paper sheets P having so far been supported on the support arms 52*a* to 52*d* are transferred to the belts 45*a*, 45*b* and 45*c* of the main stacking unit 41.

Figure 16:
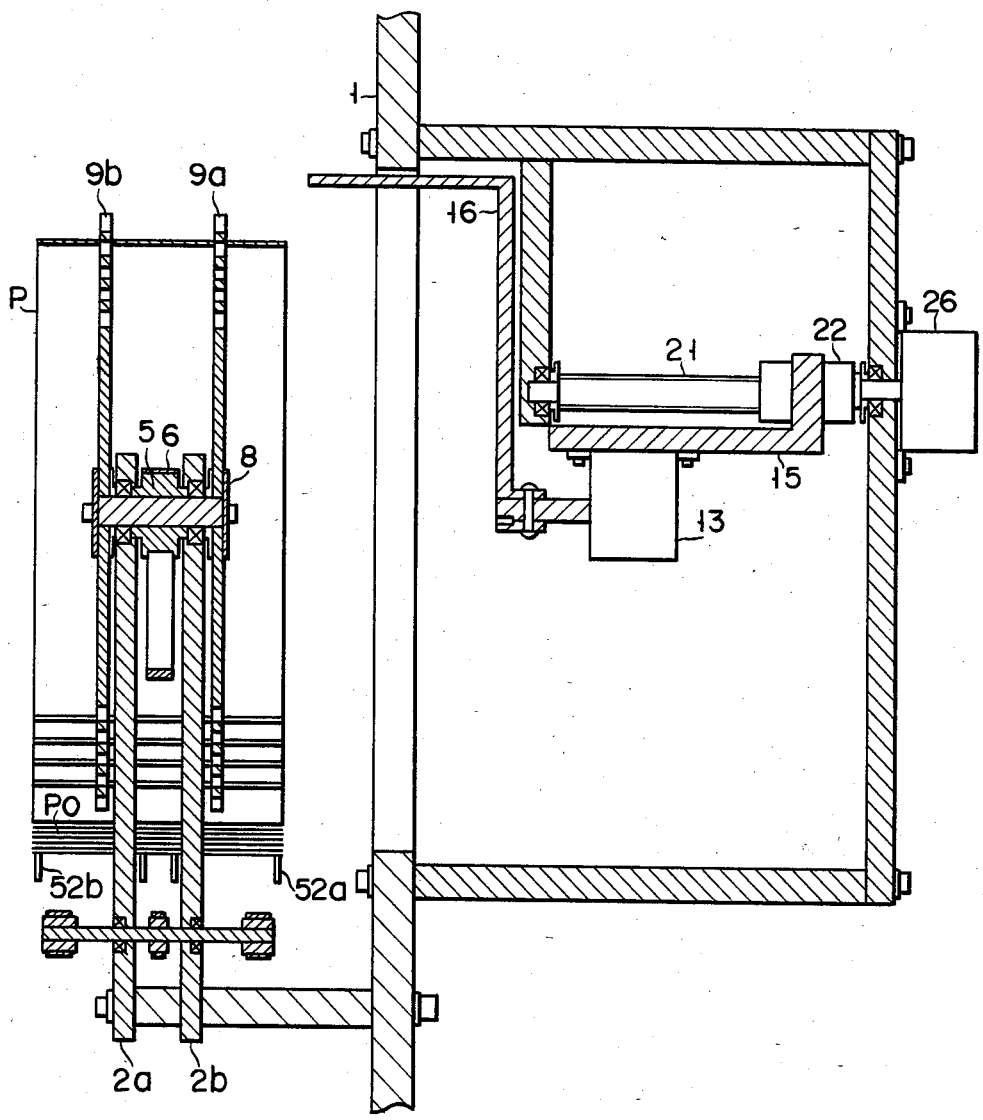

When the output $\overline{M2}$ of the inverter 114 is switched to the high level at the time t6, the AND gate 106 is opened to turn on the transistor 120, since the outputs E2 and M1 of the separator detector 62*b* and the left detector 84 are at the high level. Thus, the output of the pulse generator 118 is supplied to the reverse rotation control terminal 123 of the drive circuit 121 through the transistor 120. As a result, the pulse motor 13 starts to rotate in the reverse direction at the time t6, so that the separator 16 starts to rotate in the direction opposite to the rotating direction of the blade wheels 9*a* and 9*b*. It is to be understood that the separator 16 may alternatively be rotated in the same direction as the blade wheels 9*a* and 9*b*. At a time t8 when the separator 16 reaches a position such that the bar 61 interrupts the optical path of the upper separator detector 62*b*, the output E2 of the detector 62*b* goes low. Thus, at the time t8, the pulse motor 13 ceases to rotate, and the separator 16 stops at the position beside the stand-by position, as shown in FIG. 16.

When the output E2 of the separator detector 62*b* is switched to the low level at the time t8, the output E2 of the inverter 115 is switched to the high level. At the time t8, the output M1 of the left detector 84 is at the high level, so that the AND gate 117 is opened, allowing a reverse rotation control signal to be supplied to the drive circuit 128. Thus, the motor 26 starts to rotate in the reverse direction at the time t8, so that the separator 16 starts to move gradually from the position shown in FIG. 16 to the left. At a time t9 when the separator 16 reaches the stand-by position shown in FIG. 10, the output M1 of the left detector 84 is switched to the low level. Thus, at the time t9, the motor 26 ceases to rotate, and the separator 16 is on stand-by. Thereafter, the above-mentioned sequence of operation is repeated, based on a point of time when the output J of the sheet number detector 73 like the signal delivered at the time t1, is supplied. Thus, in the stacking apparatus with the dividing means, the paper sheets P that the continuously fed one by one are securely divided into regular sheaves of 100 sheets, which are fed one after another into an apparatus provided in the next stage.

In this case, the arm portion 17 of the separator 16 is located in the position where it can never touch the paper sheets P, that is, the position outside the facing side edges of the paper sheets P held in the spaces 11 of the blade wheels 9*a* and 9*b*. Without regard to the position of the separator 16, therefore, the arm portion 17 cannot prevent the paper sheets P from entering the spaces 11. Thus, the density of feed of the paper sheets will not be limited by the existence of the separator 16. After the separator 16 is stopped at the receiving position for division, it is removed from the space through which the paper sheets P can be dropped. In this state, the separator 16 is moved to the position beside the stand-by positon, and then set in the stand-by position. Accordingly, these movements of the separator 16 can be achieved irrespectively of the existence of the belt mechanism 31. It is therefore necessary only that the separator 16 be moved within a period during which the output J is delivered from the sheet number detector 73. Thus, the transfer speed of the separator 16 can be set relatively freely, and power consumption for the transfer can considerably be reduced.

Figure 18:
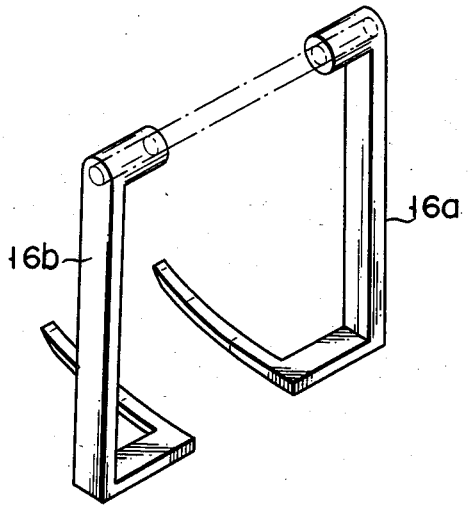
FIG. 18 is a perspective view showing a modification of the separator.

The present invention is not limited to the embodiment descrived above. In the above embodiment, the paper outlet of the belt mechanism for feeding the paper sheets is located between the blade wheels 9*a* and 9*b* so as to correspond to the outer periphery thereof. Depending on the kind of the paper sheets, however, the separator may be located outside the space between the blade wheels. The configuration of each blade of the blade wheels is not limited to the shape of an involute curve, and may be any other conventional shape. Further, the motor for rotating the separator is not limited to the pulse motor. In an alternative embodiment, as shown in FIG. 18, two separators 16*a* and 16*b* are arranged individually on both sides of the blade wheels so that they are driven in the same manner as in the foregoing embodiment. The linear drive mechanism consisting of the motor 26, the screw 21, and the nut 22 may be replaced with, for example, a combination of a rack and a pinion. Furthermore, the detectors are not limited to the photocouplers.

What is claimed is:

1. A paper sheet stacking apparatus for dividing continuously fed paper sheets into regular sheaves each consisting of a predetermined number of paper sheets, said paper sheet stacking apparatus comprising:

(a) blade wheel means rotating about a substantially horizontal axis of rotation, said blade wheel means having a plurality of blades extending from the central portion of the outer periphery thereof in the direction opposite to the rotating direction thereof, each two adjacent blades defining therebetween a space having an opening on the outer periphery of the blade wheel means;

(b) feeding means for continuously inserting the paper sheet into the spaces, one for each space, through the openings of the blade wheel means passing a predetermined accepting position;

(c) stationary stop means adapted to abut against the paper sheets held in the spaces and rotating together with the blade wheel means, thereby stopping the rotation of the paper sheets, so that the paper sheets are discharged from the spaces of the blade wheel means and dropped automatically;

(d) main stacking means for receiving and bearing thereon the paper sheets discharged from the blade wheel means;

(e) separator means rotatably supported in a substantially coaxial relation with the blade wheel means and capable of receiving the dropped paper sheets, said separator means having an arm portion extending in the radial direction of the blade wheel means along at least one side thereof, and a receiving portion for receiving the dropped paper sheets, said paper sheets dropped from the blade wheel means being adapted to be stacked on the receiving portion when said separator means is brought to a first position which is close to the blade wheel means and is rotated to reach a receiving position where the receiving portion receives the dropped paper sheets;

(f) a rotating mechanism for rotating the separator means;

(g) separator drive means for moving said separator means to said first position or to a second position which is on the side of the blade wheel means and at which the separator means is kept from contacting the paper sheets dropping from the blade wheel means;

(h) auxiliary stacking means for transferring the paper sheets on the receiving portion of the separator means to the main stacking means; and (i) control means for controlling the rotating mechanism and the separator drive mechanism so as to rotate the separator means when the separator means has been moved to the first position and stopping in a stand-by position which is beyond the accepting position as viewed along the rotating direction of the blade wheel means, to stop the separator means at the receiving position of the separator means so that the receiving portion of the separator means is brought to the first position before the first paper sheet out of the sheaf is dropped from the blade wheel means, to drive the auxiliary stacking means so that the auxiliary stacking means supports the paper sheets in place of the receiving portion after the separator means starts receiving the paper sheets, to stack the paper sheets discharged from the blade wheel means on the auxiliary stacking means, and to rotate the separator means to the stand-by position after moving the separator means having so far been at a standstill from the first position to the second position and then move the separator means again to the first position.

2. An apparatus according to claim 1, wherein said separator means includes two separators arranged on each side of the blade wheel means along the axis thereof.

3. An apparatus according to claim 1, further comprising control means adapted to rotate the separator means from said stand-by position toward said receiving position at a speed equal to the rotating speed of the blade wheel means when said apparatus is supplied with an instruction for the start of paper sheet stacking.

* * * * *